United States Patent [19]

Nagamoto

[11] Patent Number: 4,520,333

[45] Date of Patent: May 28, 1985

[54] M.B.B. TYPE CONTACT ARRANGEMENT FOR AN ELECTROMAGNETIC RELAY

[75] Inventor: Mitsuki Nagamoto, Kadoma, Japan

[73] Assignees: Matsushita Electric Works, Ltd., Japan; SDS-Elektro GmbH, Fed. Rep. of Germany

[21] Appl. No.: 488,695

[22] Filed: Apr. 26, 1983

[30] Foreign Application Priority Data

Apr. 30, 1982 [JP] Japan ..... 57-73633

[51] Int. Cl.[3] ..... H01H 67/02; H01H 1/28

[52] U.S. Cl. ..... 335/129; 335/133; 200/283; 200/1 TK

[58] Field of Search ..... 335/106, 107, 121, 126, 335/129, 130, 133, 196, 135; 200/153 LA, 1 TK, 153 V, 246, 283, 284, 1 A; 179/18 AA

[56] References Cited

U.S. PATENT DOCUMENTS 2,682,584 6/1954 Knapp ..... 335/129

FOREIGN PATENT DOCUMENTS 2074381 10/1981 United Kingdom .

OTHER PUBLICATIONS

"Engineers' Relay Handbook", 3rd edition, edited 1980 by National Association of Relay Manufacturers of Elkhart, Indiana, p. 6.

*Primary Examiner*—E. A. Goldberg
*Assistant Examiner*—George Andrews
*Attorney, Agent, or Firm*—Schwartz, Jeffery, Schwaab, Mack, Blumenthal & Koch

[57] ABSTRACT

In an M.B.B. type relay, a contact spring comprises a pair of flat spring parts integral at the base of the spring and separate at their free ends, each of which cooperates with a fixed contact. An actuating card drives both spring parts in the same direction and has a stepped portion so dimensioned that a first contact formed by one of the spring parts with one of the fixed contacts is closed before the second contact formed by the other spring part with the other fixed contact is opened.

6 Claims, 7 Drawing Figures

M.B.B. TYPE CONTACT ARRANGEMENT FOR AN ELECTROMAGNETIC RELAY

Figure 1:
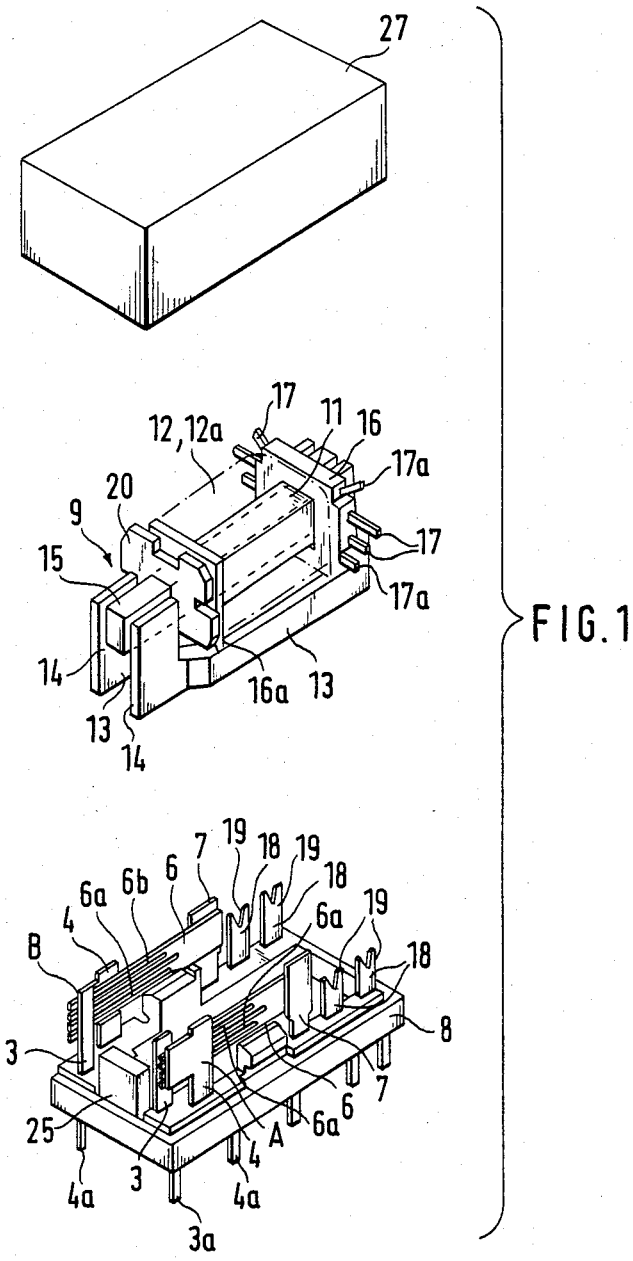

This invention relates to an M.B.B. (Make-Before-Break) type contact arrangement and an electromagnetic relay including such contact arrangements.

A contact arrangement of the M.B.B. function, as used for instance with electromagnetic relays, is known as such from item D in the table on page 6 in "Engineers" Relay Handbook" 3rd edition, edited 1980 by National Association of Relay Manufacturers of Elkhart, Ind., U.S.A. As is shown there, an M.B.B. type contact system is a specific type of transfer contact system including a normally-closed contact couple and a normally-open contact couple.

In many applications in which an M.B.B. type contact system is used, it is vital to ensure that the respective one of the two contact couples is closed or made before the other one is opened or broken. In prior art contact arrangements of this type, where two movable contacts were provided, each for cooperating with an associated fixed contact, manufacturing tolerances have made it difficult to drive both movable contacts by the respective actuating member in such a manner that the desired M.B.B. function is reliably achieved. In addition to precise manufacture, a time-consuming adjusting process for the actuating member has been indispensable.

It is an object of the present invention to facilitate the manufacture of a contact arrangement of the M.B.B. type, specifically the manufacture of the actuating member thereof, at sufficient accuracy to ensure reliable operation.

In view of this object, the present invention provides an M.B.B. type contact arrangement comprising first and second contact spring means having contact portions juxtaposed in a first direction and movable in a second direction extending transversely of the first direction, a first fixed contact member forming a first contact couple with the contact portion of the first spring means, and a second fixed contact member forming a second contact couple with the contact portion of the second spring means, said first and second fixed contact members being disposed on opposite sides of said juxtaposed contact spring means and spaced apart along said second direction, and an actuating member movable along said second direction and having an edge with a step separating a first section of the edge from a second section thereof, the first and second edge sections being adapted to move said first and second contact spring means, respectively, into and out of engagement with said first and second fixed contact members, the height of said step being so dimensioned in relation to the spacing between the fixed contact members that, in either direction of movement of the actuating member, one contact couple is closed before the other is opened.

Due to this concept, the contact springs may be manufactured by press-punching from a flat plate material without requiring bending, so that high accuracy can be easily obtained. Further, since both contact springs are driven by the same, stepped edge of the actuator, the latter may be manufactured with the required dimensional accuracy by, for example, molding metallic or plastics material or by a press-punching step. Since both contact springs are driven from the same side by the edge of the actuating member, the characteristics of both springs will be similar thereby further increasing the working accuracy and reliability of the contact arrangement. At the same time, the contact arrangement is easy to assemble since no mechanical locking is required between the actuating member and the contact springs.

In a preferred embodiment of the invention, the first and second contact spring means are integral parts of one leaf spring having a common base opposite to the movable contact portions. Manufacture of the contact arrangement is thereby further simplified. Simultaneously, the reliability of the desired switching function is enhanced since both contact springs will be in a fixed relationship with respect to each other in their rest condition.

In another preferred embodiment, each spring part has an elongate slot extending from the free end opposite the base to provide a pair of twin contacts. The reliability of each contact couple is thereby further increased.

The contact arrangement specified above is particularly suited for use in an electromagnetic relay in which the actuating member is formed by a card connected to the free end of an armature pivoted in response to energization of a relay coil. Alternatively, the contact arrangement of the present invention may be employed in a microswitch or limit switch, wherein the actuating member is formed by a pushbutton.

Figure 2A:
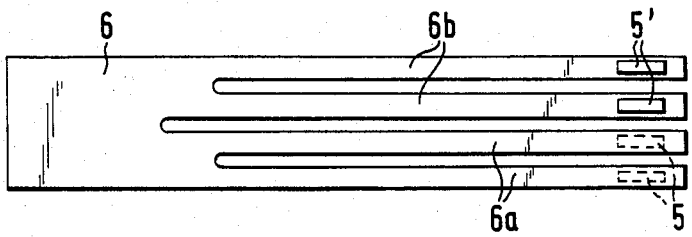
Figure 2B:
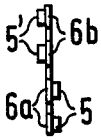
Figure 3:
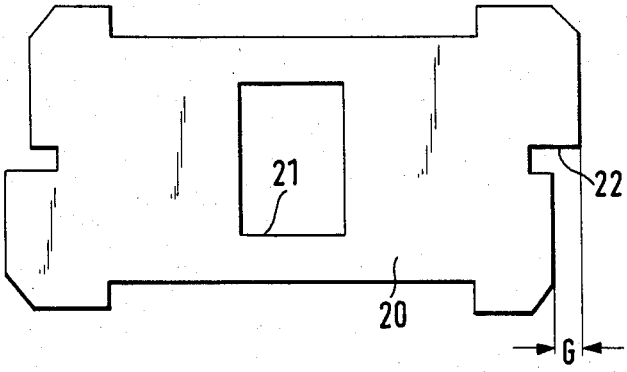

A preferred embodiment will now be described in detail with reference to the, drawings, in which FIG. 1 is an exploded perspective view of an electromagnetic relay embodying the present invention, FIG. 2 shows one of the contact springs used in the relay of FIG. 1, with FIG. 2(*a*) being a side view and FIG. 2(*b*) an end view of the contact spring, FIG. 3 is a plane view of the actuating card employed in the relay of FIG. 1, and FIGS. 4(*a*) to 4(*c*) are end views of the contact arrangement showing the actuating card and contact spring in different positions during a transfer operation.

The electromagnetic relay shown in FIG. 1 is made up of a base 8 including two switch units A and B, an electromagnet block 9 and a casing 27.

Each switch unit A, B comprises a pair of fixed contact members 3 and 4 provided with contact terminals 3*a* and 4*a*, a movable contact spring 6 having its base portion connected to a contact terminal 7, and coil terminals 18. The contact and coil terminals 3*a*, 4*a*, 7 and 18 are embedded in the synthetic resin material of which the base 8 is formed, and identical terminals are arranged symmetrically along both longer sides of the base.

The electromagnet block 9 comprises coils 12 and 12*a* wound on a cylindrical bobbin 11 having flanges 16 and 16*a*, an armature 15 extending through an axial opening of the bobbin 11, and yokes 13 bridging the length of the bobbin 11 and forming a pair of mutually opposite pole faces 14 at each end of the yokes 13. A permanent magnet (not shown) is disposed uncerneath the coils 12, 12*a* in FIG. 1 between the yokes 13. The armature 15 of magnetic material has both ends interposed between the pairs of magnetic pole faces 14. Referring to FIG. 1, the rear end of the armature 15 is pivotally supported while the front end is adapted to move between the pole faces 14 in a direction substantially perpendicular to these faces. Lead terminals 17 for connection to the coils 12, 12*a* are embedded in the flange 16 of the bobbin 11 so as to extend laterally therefrom. An actuating card 20 shown in detail in FIG. 3 is mounted on the armature 15 close to the front end thereof, the armature 15 penetrating through a central opening 21 in the card 20.

In assembly, the electromagnet block 9 is inserted into a central recess formed in the base 8 and confined by an end protection 25 and further lateral projections, in such a manner that the lead terminals 17 engage U-shaped cut-outs 19 provided at the upper ends of the coil terminals 18. The lead terminals 17 have further ends 17*a* also extending from the bobbin flange onto which the ends of the coils 12, 12*a* are wound and soldered.

The electromagnetic relay so far described is known from FIG. 3 of U.K. patent application publication No. 2 074 381.

Referring to FIGS. 2(*a*) and 2(*b*), the contact spring 6 includes two spring parts which are separated from each other by an elongate slot extending from the free end of the contact spring so that the two parts are interconnected only at the spring base. Each spring part is again subdivided by an elongate slot extending from the free spring and into a pair of twin contacts 6*a* and 6*b*. A contact portion 5 is provided on one side of each of the sections 6*a* close to the free end thereof, and a similar contact portion 5' is disposed on the other side of the spring sections 6*b*, again close to the ends thereof.

The contract spring 6 is manufactured from flat plate material by a press-punch process.

The actuating card 20 shown in FIG. 3 is formed as a flat plate of insulating material, such as nylon or ceramic, and is manufactured by a plastic mold or press process. Each lateral edge of the card 20 is divided by a stepped portion 22 to form two edge sections spaced by different distances from the central opening 21 of the card 20, the difference between these distances defining the height G of the stepped portion 22. In the assembled condition of the relay shown in FIG. 1, the card 20 is so disposed between the contact springs arranged on both sides of the relay base 8 that tne upper edge sections of the card 20 cooperate with the upper spring sections 6*b* and the lower edge sections of the card 20 cooperate with the lower spring sections 6*a* of each contact spring 6.

The operation of the electromagnetic relay will now be described with reference to FIGS. 4(*a*) to 4(*c*). In FIG. 4(*a*) the card 20 engages with none of the spring sections 6*a*, 6*b*, so that the contact portions 5 provided on the spring sections 6*a* are in their normally-closed condition in which they abut against a contact portion 1 provided on the fixed contact 3, whereas the contact portions 5' provided on the spring sections 6*b* are in their normally-open condition in which they are separated from a contact portion 2 provided on the fixed contact 4.

Figure 4A:
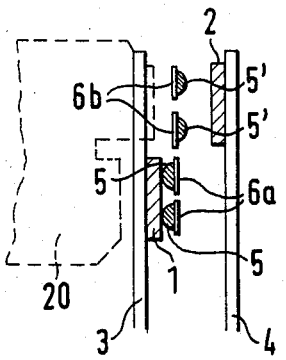
Figure 4B:
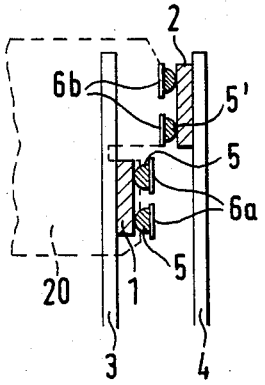
Figure 4C:
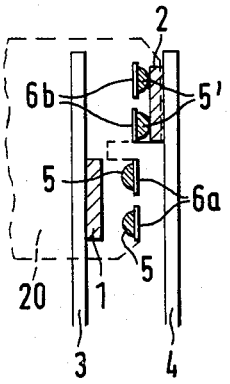

When the armature of the relay moves the card 20 to the right in FIG. 4, the upper edge section will be brought into contact with the upper spring sections 6*b* and urge the contact portions 5' into abutment with the contact portion 2 provided on the fixed contact 4. As shown in FIG. 4(*b*), the contact portions 5 provided on the lower spring sections 6*a* will still be in contact with the contact portion 1 provided on the fixed contact 3 when the contact portions 5' come into contact with the contact portion 2.

When the card 20 continues to move, the contact portions 5 on the lower spring sections 6*a* are removed from the contact portion 1 on the fixed contact 3, while the contact portions 5' on the upper spring sections 6*b* are further pressed against the contact portion 2 on the fixed contact 4, as shown in FIG. 4(*c*).

When the card 20 is moved to the left in FIG. 4, the contact portions 5 on the lower spring sections 6*a* will first abut against the contact portion 1 on the fixed contact 3, and thereafter the contact portions 5' on the upper spring sections 6*b* will separate from the contact portion 2 on the fixed contact 4.

For the operation of the emoodiment shown in FIG. 4, it is necessary for the contact spring 6 to be biased so that the spring sections 6*a* form a normally-closed contact with the contact portion 1 and tne upper spring sections 6*b* form a normally-open contact with the contact portion 2. In this normal or rest condition of the contact arrangement represented in FIG. 6(*a*), the upper edge section of the card 20 may be clear of the upper spring sections 6*b*, alternatively, it may just touch the spring sections 6*b*.

I claim:

1. An M.B.B. type contact arrangement comprising first and second contact spring means having contact portions juxtaposed in a first direction and movable in a second direction extending transversely to said first direction, a first fixed contact member forming a first contact couple with the contact portion of said first spring means, and a second fixed contact member forming a second contact couple with the contact portion of said second spring means, said first and second fixed contact members being disposed on opposite sides of said juxtaposed contact spring means and spaced apart along said second direction, an actuating member movable along said second direction and having an edge with a step separating a first section of said edge from a second section thereof, said first and second edge sections being adapted to move said first and second contact spring means, respectively, into and out of engagement with said first and second fixed contact members, the height of said step being so dimensioned in relation to the spacing between said fixed contact members that, in either direction of movement of said actuating member, one contact couple is closed before the other is opened.

2. The contact arrangement of claim 1, wherein said first and second contact spring means are integral parts of one leaf spring having a common base opposite to said movable contact portions.

3. The contact arrangement of claim 2, wherein each of said spring means has an elongate slot extending from the free end opposite said base to provide a pair of twin contacts.

4. An electromagnetic relay including a coil defining an axis and having an opening extending along said axis, an armature extending through said coil opening, pivoted at one end and having its other end movable in a direction transverse to the coil axis, and an M.B.B. type contact arrangement comprising first and second contact spring means having contact portions juxtaposed in a first direction extending transversely of said coil axis, and movable in a second direction extending transversely to said first direction and said coil axis, a first fixed contact member forming a first contact couple with the contact portion of said first spring means, and a second fixed contact member forming a second contact couple with the contact portion of said second spring means, said first and second fixed contact members being disposed on opposite sides of said juxtaposed contact spring means and spaced apart along said second direction, and an actuating card connected to the free end of said armature for movement along said second direction and having an edge with a step separating a first section of said edge from a second section thereof, said first and second edge sections being adapted to move said first and second contact spring means, respectively, into and out of engagement with said first and second fixed contact members, the height of said step being so dimensioned in relation to the spacing between said fixed contact members that, in either direction of movement of said actuating card, one contact couple is closed before the other is opened.

5. The relay of claim 4, wherein said first and second contact spring means are integral parts of one leaf spring having a common base opposite to said movable contact portions.

6. The relay of claim 5, wherein each of said spring means has an elongate slot extending from the free end opposite said base to provide a pair of twin contacts.

* * * * *